US010181664B2

(12) United States Patent
Murata

(10) Patent No.: US 10,181,664 B2
(45) Date of Patent: Jan. 15, 2019

(54) CONTACT AND CONNECTOR

(71) Applicant: FUJITSU LIMITED, Kawasaki-shi, Kanagawa (JP)

(72) Inventor: Yoko Murata, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/680,485

(22) Filed: Aug. 18, 2017

(65) Prior Publication Data

US 2018/0062288 A1 Mar. 1, 2018

(30) Foreign Application Priority Data

Aug. 31, 2016 (JP) ..... 2016-169511

(51) Int. Cl.

| | |
|---|---|
| ***H01R 12/50*** | (2011.01) |
| ***H01R 12/70*** | (2011.01) |
| ***H01R 12/71*** | (2011.01) |
| ***H01R 12/91*** | (2011.01) |
| ***H01R 13/24*** | (2006.01) |
| ***H01R 13/50*** | (2006.01) |
| ***H01R 43/26*** | (2006.01) |

(52) U.S. Cl.

CPC ..... *H01R 12/714* (2013.01); *H01R 12/7047* (2013.01); *H01R 12/91* (2013.01); *H01R 13/2407* (2013.01); *H01R 13/50* (2013.01); *H01R 23/722* (2013.01); *H01R 43/26* (2013.01)

(58) Field of Classification Search

CPC .... H01R 23/722; H01R 9/096; H01R 23/725; H01R 23/7068; H01R 12/714; H01R 12/7047; H01R 12/91; H01R 13/2407; H01R 13/50; H01R 43/26

USPC ..... 439/65, 62

See application file for complete search history.

(56) References Cited

U.S. PATENT DOCUMENTS

| | | | | | |
|---|---|---|---|---|---|
| 3,270,311 | A * | 8/1966 | Deer | H05K 7/1417 | 439/65 |
| 3,631,380 | A * | 12/1971 | Bohn | H01R 12/714 | 439/590 |
| 3,715,706 | A * | 2/1973 | Michel | H01R 12/714 | 439/493 |
| 5,473,242 | A * | 12/1995 | McKenna | H01M 2/1055 | 320/113 |
| 5,520,545 | A * | 5/1996 | Sipe | H01R 13/28 | 439/65 |
| 5,599,192 | A * | 2/1997 | Olson | H01R 12/716 | 439/65 |
| 5,885,090 | A * | 3/1999 | Comstock | H01R 13/2442 | 439/65 |

(Continued)

FOREIGN PATENT DOCUMENTS

| | | |
|---|---|---|
| JP | 2001-068184 A | 3/2001 |
| JP | 2011-014271 A | 1/2011 |

*Primary Examiner* — Gary F Paumen

(74) *Attorney, Agent, or Firm* — Fujitsu Patent Center

(57) ABSTRACT

A contact includes a spring that has a curved portion and conductivity, a first contact portion that is a part of the curved portion raised from a bottom portion of a housing that holds the spring, the first contact portion comes in contact with a board to which the bottom portion is fixed, and a second contact portion that is a part of the curved portion raised from a lateral portion of the housing, the second contact portion comes in contact with another member placed next to the board.

6 Claims, 17 Drawing Sheets

(56) References Cited

U.S. PATENT DOCUMENTS

| | | | | |
|---|---|---|---|---|
| 6,155,844 | A * | 12/2000 | Semmeling | H01R 13/24 439/65 |
| 6,406,305 | B1 * | 6/2002 | Wu | H01R 12/52 439/629 |
| 6,719,567 | B2 * | 4/2004 | Billman | H01R 12/714 439/65 |
| 7,063,540 | B2 * | 6/2006 | Sun | H01R 12/714 439/500 |

* cited by examiner

CONTACT AND CONNECTOR

CROSS-REFERENCE TO RELATED APPLICATION

This application is based upon and claims the benefit of priority of the prior Japanese Patent Application No. 2016-169511, filed on Aug. 31, 2016, the entire contents of which are incorporated herein by reference.

FIELD

The embodiments discussed herein are related to a contact and a connector.

BACKGROUND

Various connectors are used for electronic devices.

Various connectors are installed on boards of electronic devices to be used for connection to other boards or cables. A connector is generally soldered on a board. However, in an environment where a temperature largely changes, stress is applied to the soldered portion due to thermal stress caused by a difference between a thermal expansion coefficient of the board and a thermal expansion coefficient of the connector. Thus, for example, it may be taken into account to use a connector equipped with a movable mechanism that absorbs displacement, such as a floating connector, so as to reduce the stress caused by the thermal stress. However, the stress may not be sufficiently reduced. Further, for example, it may be taken into account to enhance proof stress against the stress caused by the thermal stress, by increasing the amount of the solder so as to enlarge the area of the welded portion. However, since the stress is not reduced, a risk of an occurrence of cracks remains.

In addition, when a plurality of boards is desired to be connected to each other, connectors that are generally fitted with each other in the connection direction of the boards are installed at the edges of the boards. However, for these connectors, a space where each board slides for the fitting is provided within a housing of an electronic device, or the boards are connected to each other in advance prior to being placed in the housing of the electronic device. When the space for the sliding of the boards is provided within the housing, the miniaturization of the electronic device becomes difficult. Further, when the boards are connected to each other in advance, the assembling work in the housing becomes difficult.

The followings are reference documents.

[Document 1] Japanese Laid-Open Patent Publication No. 2011-014271 and

[Document 2] Japanese Laid-Open Patent Publication No. 2001-068184.

SUMMARY

According to an aspect of the invention, a contact includes a spring that has a curved portion and conductivity, a first contact portion that is a part of the curved portion raised from a bottom portion of a housing that holds the spring, the first contact portion comes in contact with a board to which the bottom portion is fixed, and a second contact portion that is a part of the curved portion raised from a lateral portion of the housing, the second contact portion comes in contact with another member placed next to the board.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Hereinafter, embodiments will be described. The embodiments described below are merely exemplary, and the technical scope of the present disclosure is not limited to the aspects described below.

Figure 1:
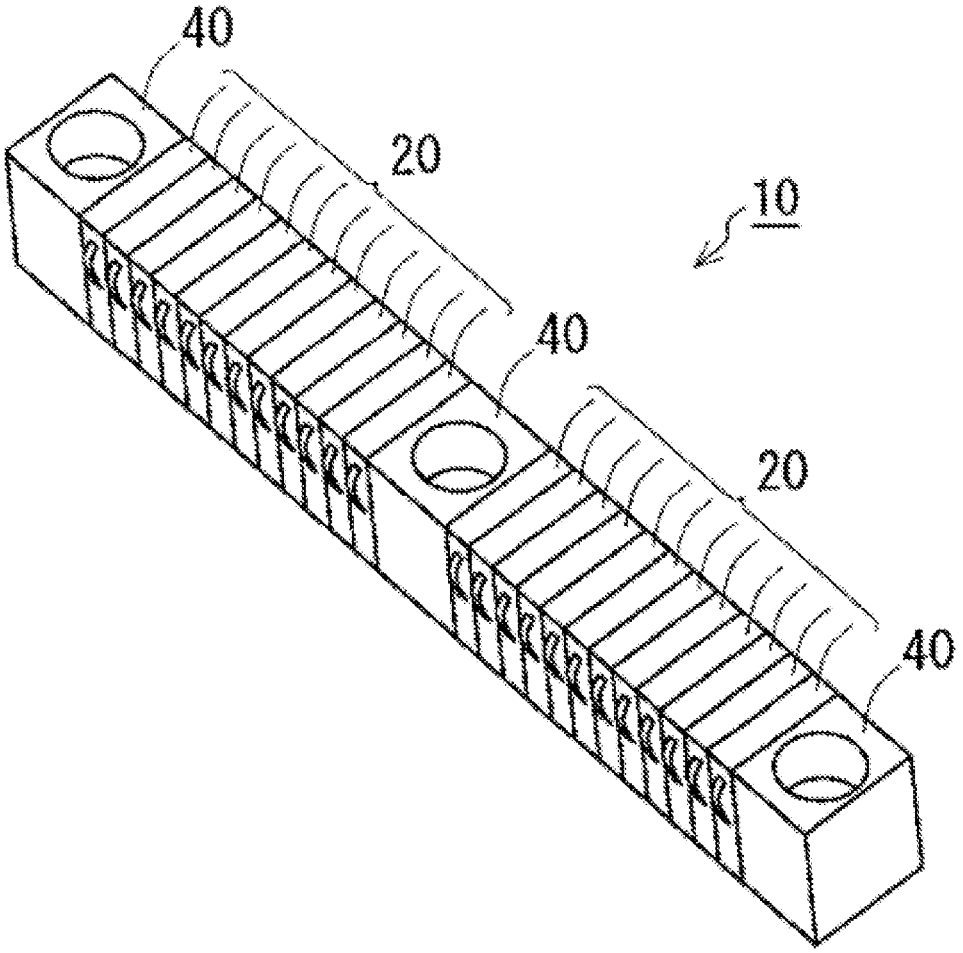
FIG. 1 is a view illustrating an example of a connector.

FIG. 1 is a view illustrating an example of a connector. A connector 10 is mounted on a board and used for electric connection between the board and another member. The connector 10 is an aggregate of a plurality of contact assemblies 20 and has a bar shape in its entirety. Further, the connector 10 includes a plurality of fixed terminal assemblies 40 that are connected to the center and the opposite ends of the aggregate of the contact assemblies 20. Here, the connector 10 may have the fixed terminal assemblies 40 at a plurality of other appropriate portions, in addition to the opposite ends, or have the fixed terminal assemblies 40 at only the opposite ends. In addition, the number of the contact assemblies 20 provided in the connector 10 may be appropriately increased or decreased according to the number of wires desired to be electrically connected by the connector 10. The contact assemblies 20 and the fixed terminal assemblies 40 are connected to each other by adhesives, fitting pins, elongated screws, heat welding, or various kinds of other joining methods.

Figure 2:
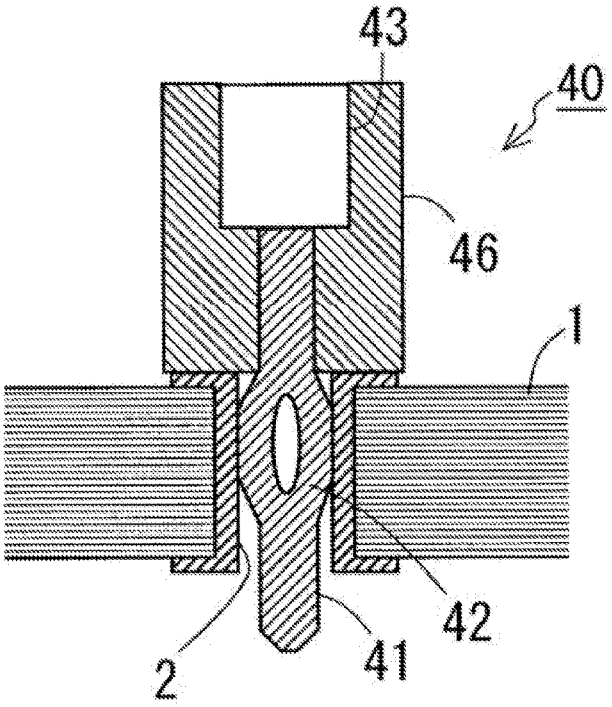
FIG. 2 is a view illustrating an example of a structure of a fixed terminal assembly.

FIG. 2 is a view illustrating an example of a structure of a fixed terminal assembly 40. As illustrated in FIG. 2, the fixed terminal assembly 40 includes a press fit terminal 41 configured to fix the connector 10 to a board 1, and a housing 46 that holds the press fit terminal 41. The press fit terminal 41 has a bulge portion 42 that is fitted in a through hole 2 of the board 1 when being press-fitted into the through hole 2. In addition, the housing 46 has a hole 43 to be engaged with another member to be electrically connected via the connector 10.

Figure 3:
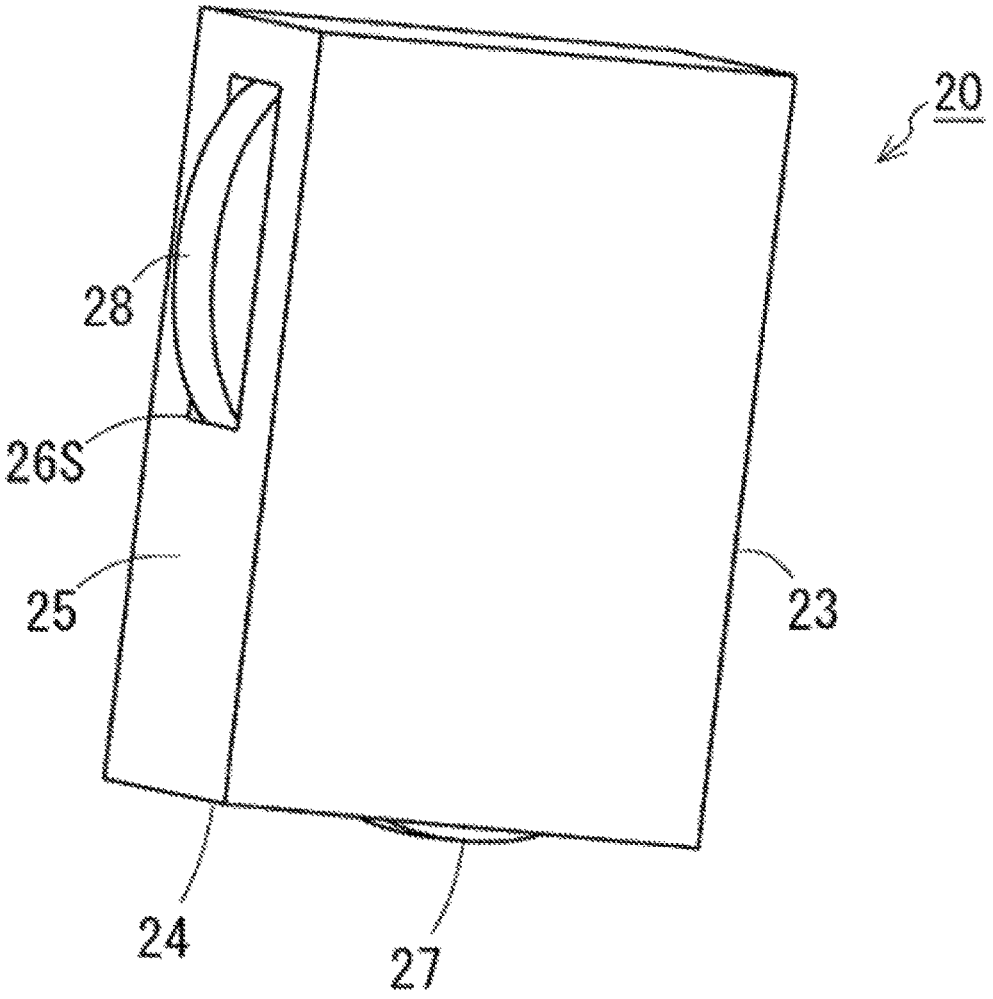
FIG. 3 is a view illustrating an example of an external appearance of a contact assembly.
Figure 4:
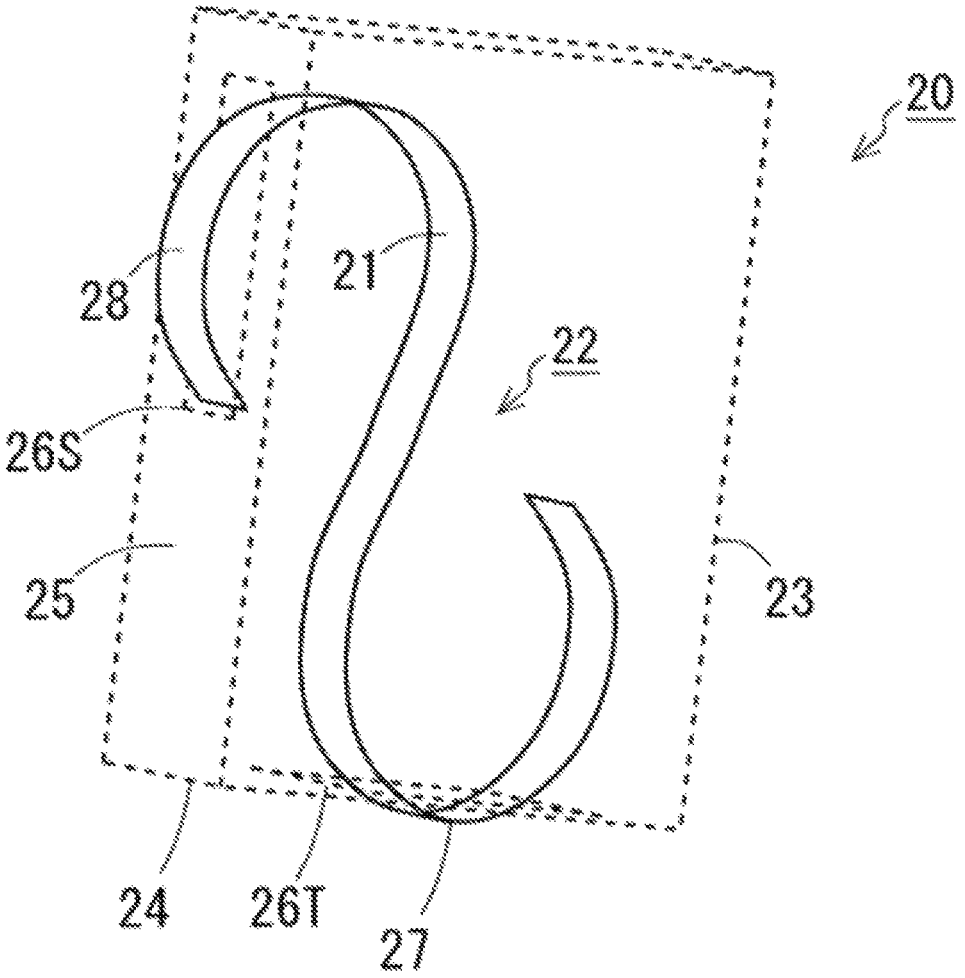
FIG. 4 is a view illustrating an example of an internal structure of the contact assembly.

FIG. 3 is a view illustrating an example of an external appearance of a contact assembly 20. Further, FIG. 4 is a view illustrating an example of an internal structure of the contact assembly 20. The contact assembly 20 has a housing 23 having a cuboid external appearance, and a contact 22 formed by an S-shaped conductive spring 21 having curved portions. A window 26T is provided in the bottom portion 24 of the housing 23 that faces the board 1 when the connector 10 is mounted on the board 1. Further, a window 26S is provided in the lateral portion 25 of the housing 23 that faces another member to be electrically connected to the board 1 via the connector 10. In addition, the curved portions of the spring 21 are raised from the windows 26T and 26S, respectively. The curved portion of the spring 21 raised from the window 26T forms a first contact portion 27 to be in contact with the board 1. Further, the curved portion of the spring 21 is raised from the window 26S forms a second contact portion 28 to be in contact with another member to be electrically connected to the board 1 via the connector 10.

Figure 5:
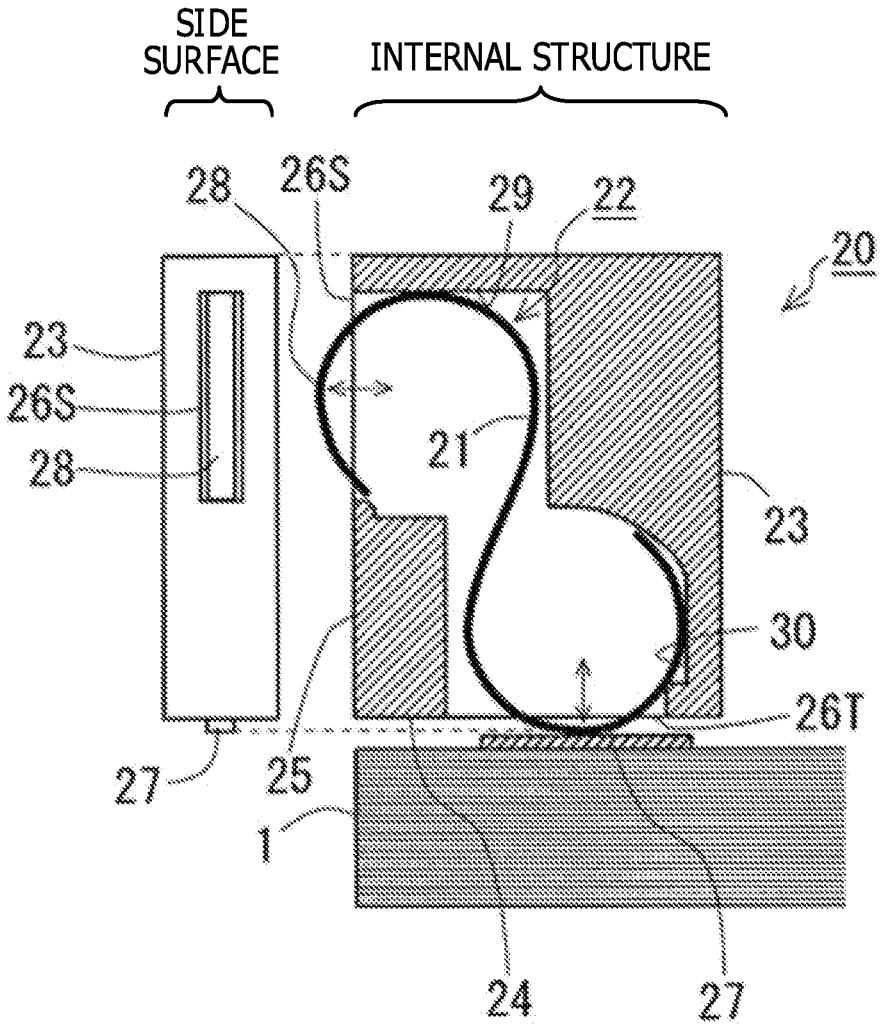
FIG. 5 is a view illustrating an example of a movable range of a contact.

FIG. 5 is a view illustrating an example of a movable range of the contact 22. The contact 22 is stored inside the housing 23. The top portion of the contact 22 is supported by a first support portion 29 that supports the contact 22 toward the bottom portion 24 of the housing 23. Further, the bottom portion of the contact 22 is supported by a second support portion 30 that supports the contact 22 toward the lateral portion 25 of the housing 23. Accordingly, while the contact 22 is configured to be slightly moved inside the housing 23, the contact 22 exhibits its elastic force by being supported by the first support portion 29 so as to press the first contact portion 27 toward the board 1 when the first contact portion 27 comes into contact with the board 1. Further, when the second contact portion 28 comes into contact with another member, the contact 22 exhibits its elastic force by being supported by the second support portion 30 so as to press the second contact portion 28 toward the another member.

The contact 22 has a structure in which the contact 22 is conducted even when merely the first contact portion 27 comes into contact with the board 1, and the welding by soldering or the like is unnecessary. Accordingly, in a case where the board 1 is placed under an environment where the temperature largely changes, even when a difference between a thermal expansion coefficient of the board 1 and a thermal expansion coefficient of the connector 10 occurs, the first contact portion 27 does not undergo the thermal stress caused by the difference of the thermal expansion coefficients.

Figure 6:
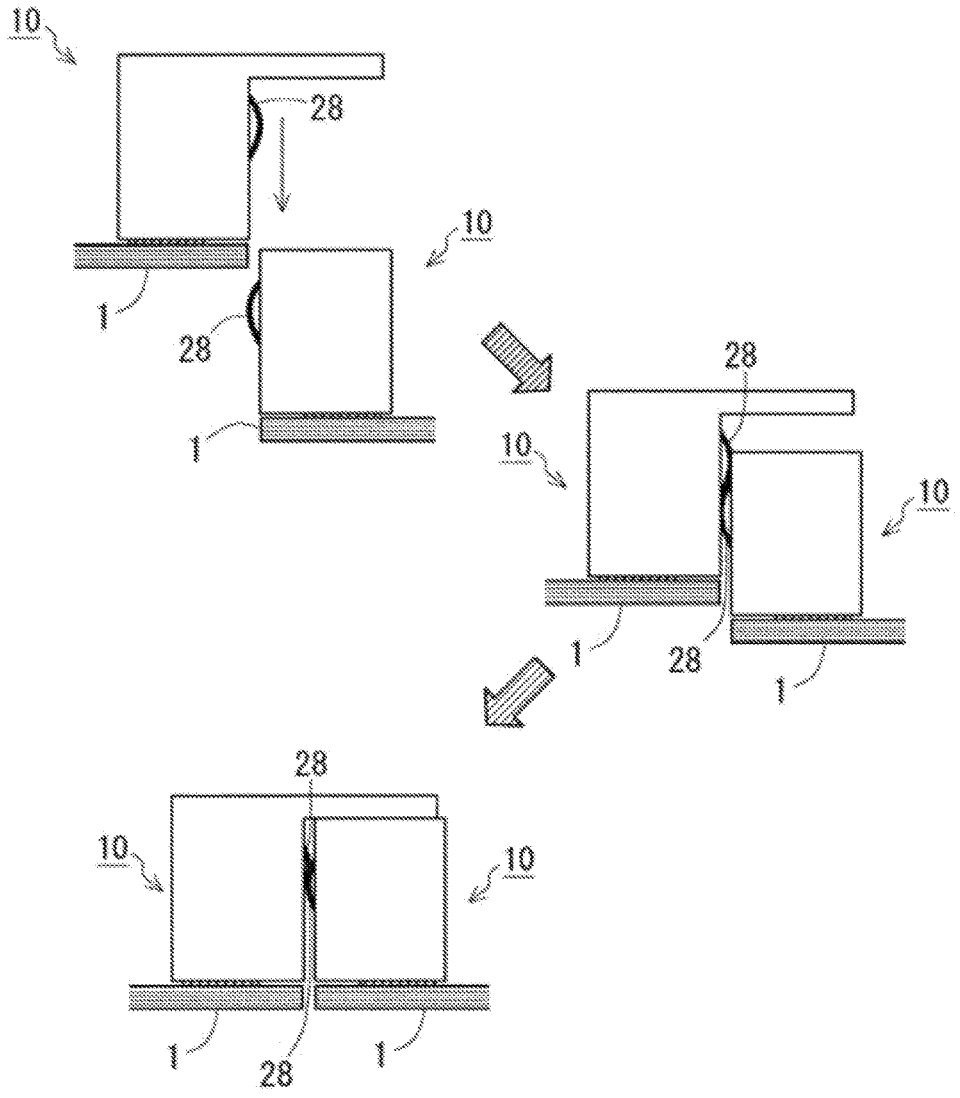
FIG. 6 is a view illustrating an example of a method of connecting connectors to each other.

FIG. 6 is a view illustrating an example of a method of connecting connectors 10 to each other. Since the second contact portion 28 of each connector 10 is the curved portion of the spring 21 raised from the window 26S, boards 1 each fixing the connector 10 to the edge thereof are caused to be relatively moved along the direction vertical to the plate surface of each board 1 such that the contact portions of the boards 1 may be connected to each other. Since the second contact portion 28 of the connector 10 is the curved portion of the spring 21, the second contact portion 28 of the connector 10 may slide and move in a state of being in contact with the second contact portion 28 of an opposing connector 10.

Figure 7:
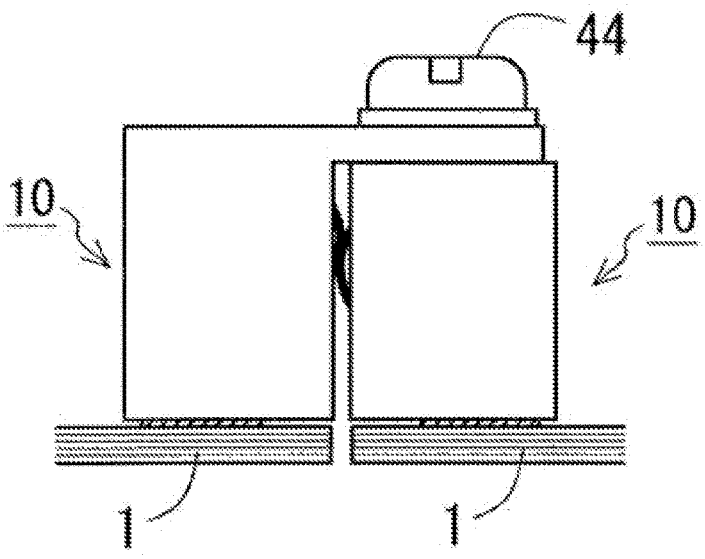
FIG. 7 is a view illustrating a first example of a method of fixing the connectors to each other.
Figure 8:
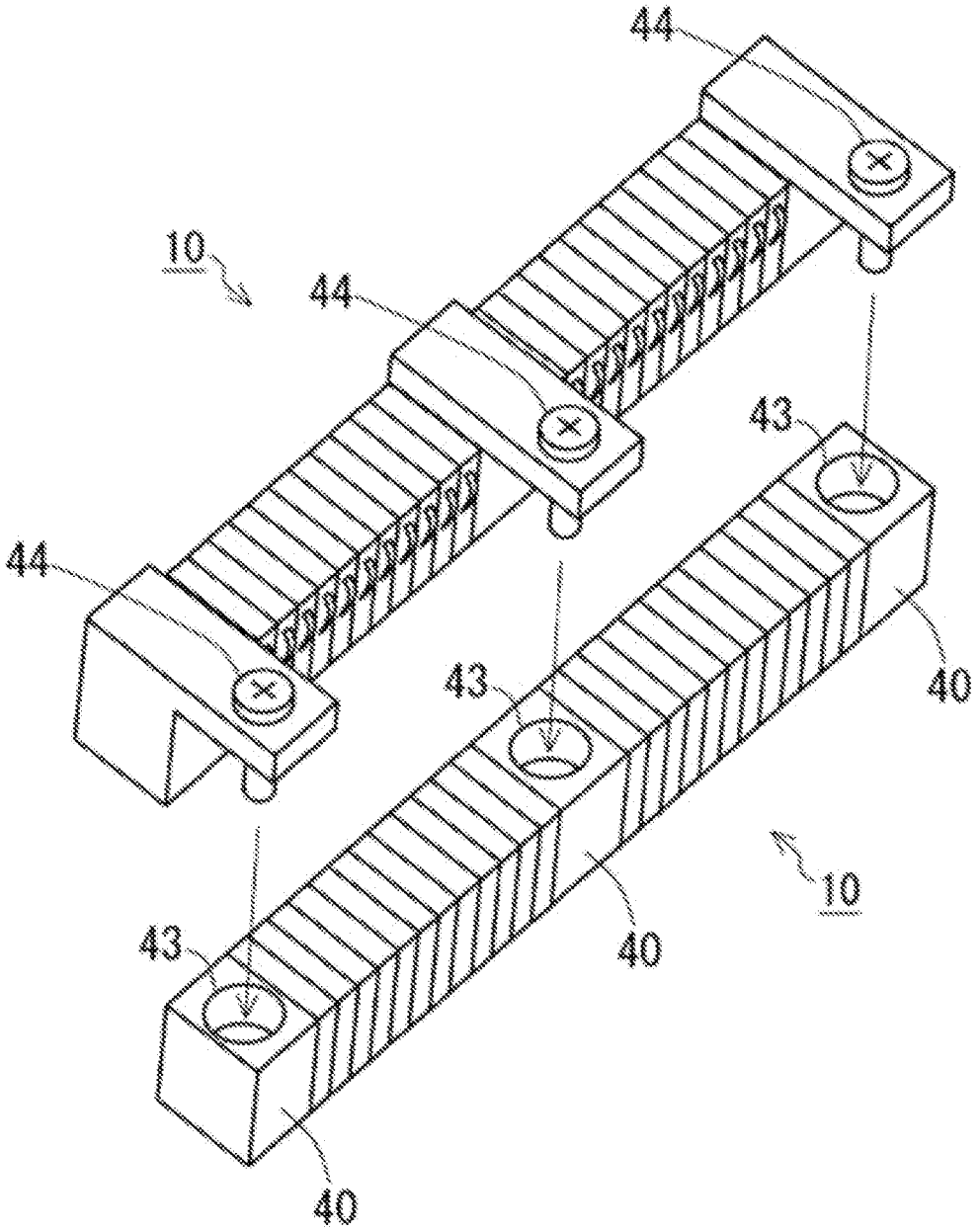
FIG. 8 is a view illustrating an example of an attachment position of a screw.

FIG. 7 is a view illustrating a first example of a method of fixing the connectors 10 to each other. The method of fixing the connectors 10 to each other may be, for example, a method using a screw 44 as illustrated in FIG. 7. FIG. 8 is a view illustrating an example of an attachment position of the screw 44. For example, as illustrated in FIG. 8, the screw 44 used for fixing the connectors 10 to each other may be screwed into the hole 43 of the fixed terminal assembly 40 provided at each of the opposite ends of each connector 10. Since the fixed terminal assembly 40 is fixed to each board 1 by the press fit terminal 41, the boards 1 may also be fixed to each other when the screw 44 for fixing the connectors 10 to each other is screwed.

Figure 9:
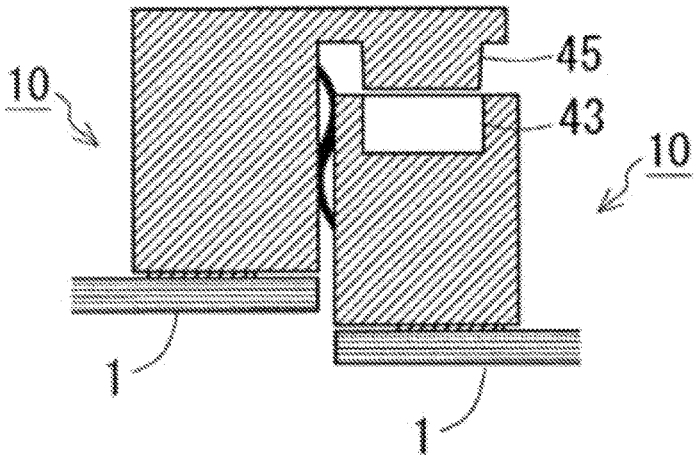
FIG. 9 is a view illustrating a second example of the method of fixing the connectors to each other.
Figure 10:
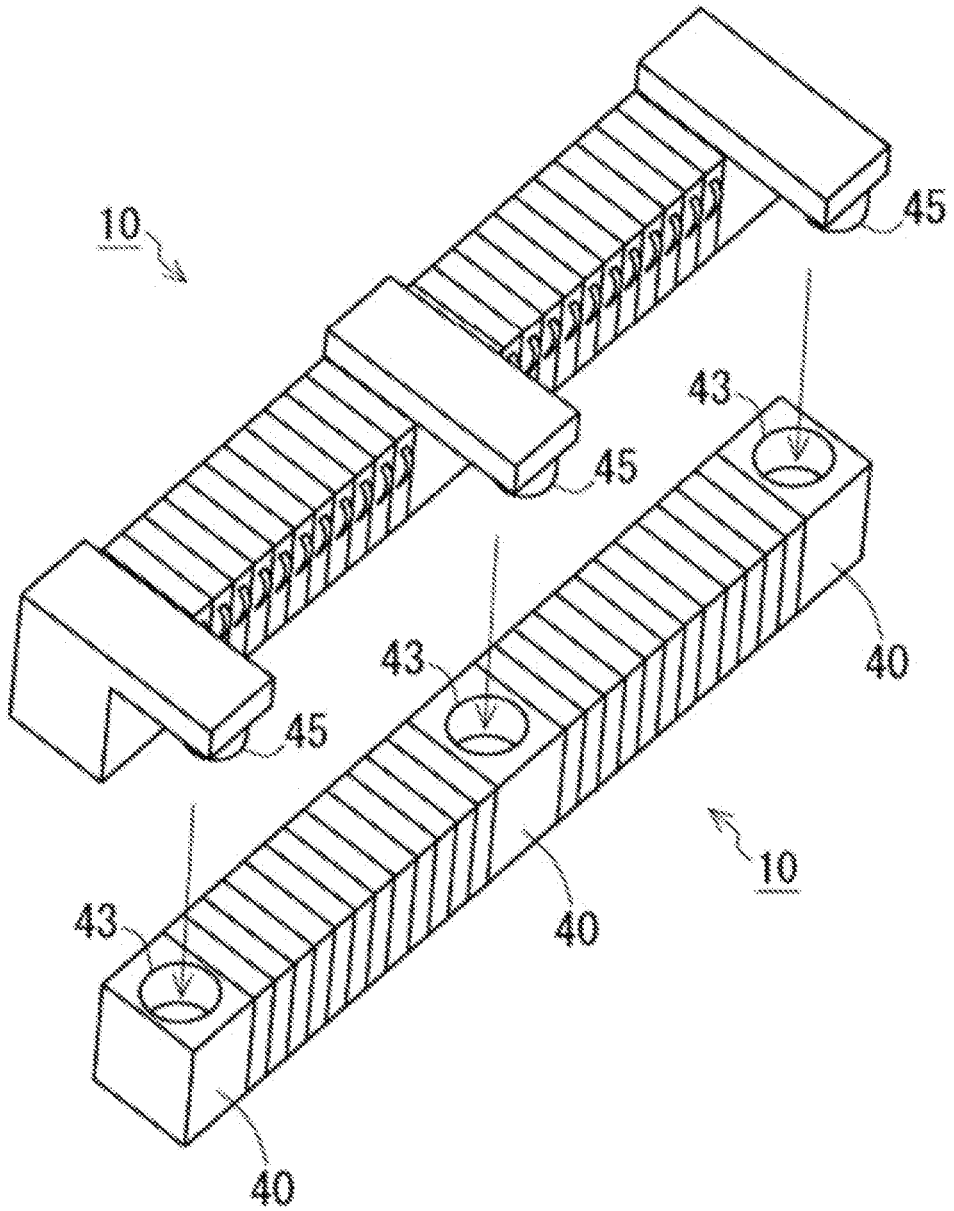
FIG. 10 is a view illustrating an example of an attachment position of a dowel.

FIG. 9 is a view illustrating a second example of the method of fixing the connectors 10 to each other. The method of fixing the connectors 10 to each other may be, for example, a method using a dowel 45 as illustrated in FIG. 9. FIG. 10 is a view illustrating an example of an attachment position of the dowel 45. For example, as illustrated in FIG. 10, the dowel 45 used for fixing the connectors 10 to each other may be fitted in the fixed terminal assembly 40 provided at each of the opposite ends of each connector 10. Since the fixed terminal assembly 40 is fixed to each board 1 by the press fit terminal 41, the boards 1 may also be easily fixed to each other when the dowel 45 for fixing the connectors 10 is fitted.

Figure 11:
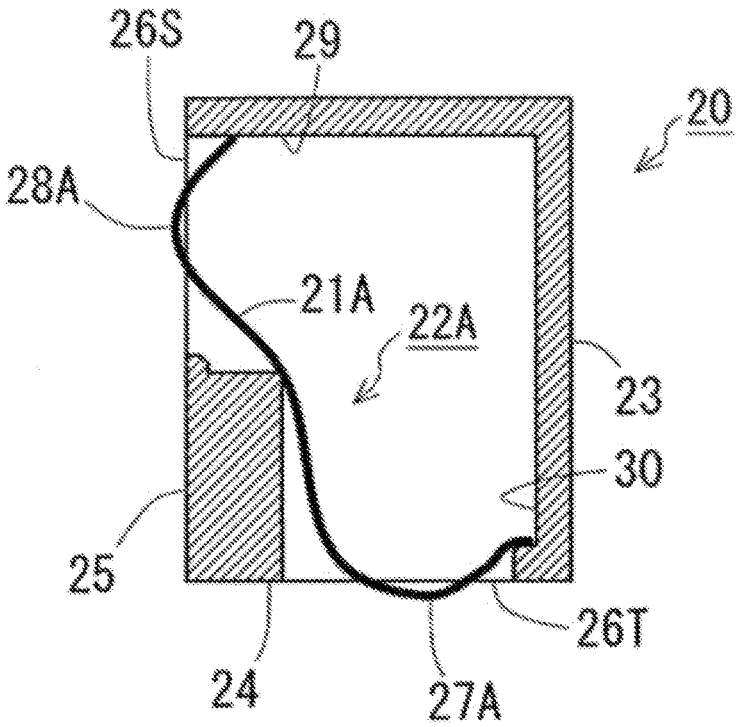
FIG. 11 is a view illustrating a first modification of the contact.

In the above-described embodiment, the contact 22 formed by the S-shaped spring 21 has been described as an example. However, the contact used for the connector 10 is not limited to the contact formed by the S-shaped spring 21. FIG. 11 is a view illustrating a first modification of the contact 22. The contact used for the connector 10 may be, for example, a contact 22A formed by a W-shaped conductive spring 21A having curved portions as illustrated in FIG. 11. As in the contact 22, in the contact 22A formed by the W-shaped spring 21A as well, the curved portion of the spring 21A raised from the window 26T forms a first contact portion 27A to be in contact with the board 1. Further, the curved portion of the spring 21A is raised from the window 26S forms a second contact portion 28A to be in contact with another member to be electrically connected to the board 1 via the connector 10.

In a state where the contact 22A is stored inside the housing 23, the top portion of the contact 22A is supported by the first support portion 29, and the bottom portion of the contact 22A is supported by the second support portion 30. Accordingly, when the first contact portion 27A comes into contact with the board 1, the contact 22A exhibits its elastic force by being supported by the first support portion 29 so as to press the first contact portion 27A toward the board 1. Further, when the second contact portion 28A comes into contact with another member, the contact 22A exhibits its elastic force by being supported by the second support portion 30 so as to press the second contact portion 28A toward the member.

Figure 12:
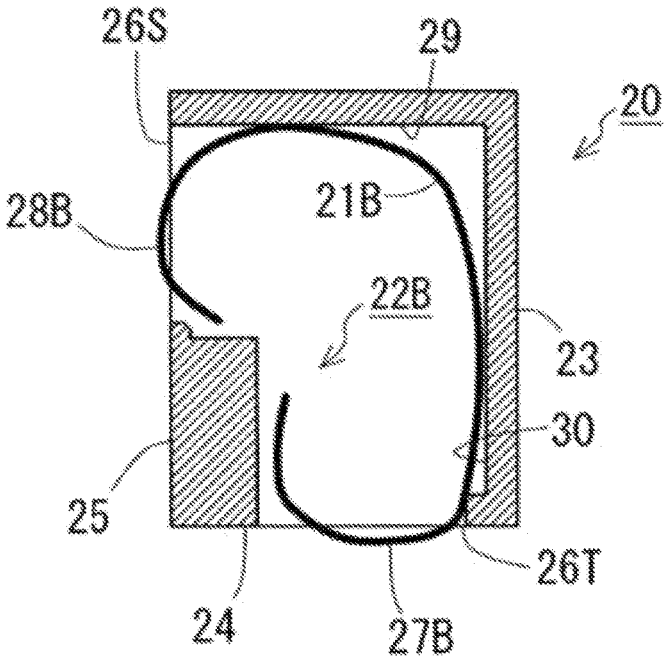
FIG. 12 is a view illustrating a second modification of the contact.

FIG. 12 is a view illustrating a second modification of the contact 22. The contact used for the connector 10 may be, for example, a contact 22B formed by a C-shaped conductive spring 21B having curved portions as illustrated in FIG. 12. As in the contact 22, in the contact 22B formed by the C-shaped spring 21B as well, the curved portion of the spring 21B raised from the window 26T forms a first contact portion 27B to be in contact with the board 1. Further, the curved portion of the spring 21B is raised from the window 26S forms a second contact portion 28B to be in contact with another member to be electrically connected to the board 1 via the connector 10.

In a state where the contact 22B is stored inside the housing 23, the top portion of the contact 22B is supported by the first support portion 29, and the bottom portion of the contact 22B is supported by the second support portion 30. Accordingly, when the first contact portion 27B comes into contact with the board 1, the contact 22B exhibits its elastic force by being supported by the first support portion 29 so as to press the first contact portion 27B toward the board 1. Further, when the second contact portion 27B comes into contact with another member, the contact 22B exhibits its elastic force by being supported by the second support portion 30 so as to press the second contact portion 28B toward the member.

Figure 13:
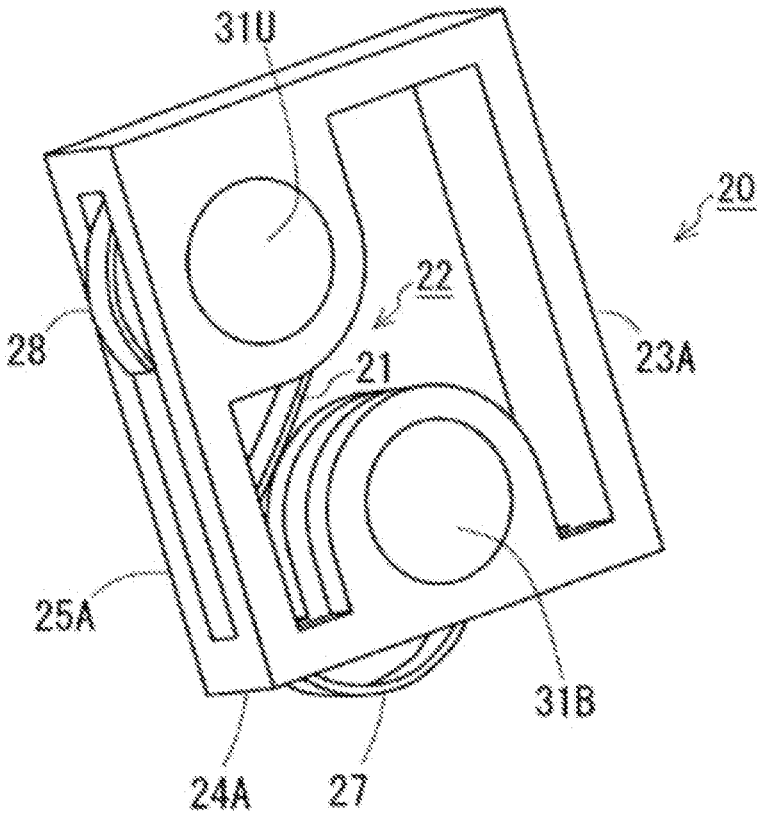
FIG. 13 is a view illustrating a modification of a housing.
Figure 14:
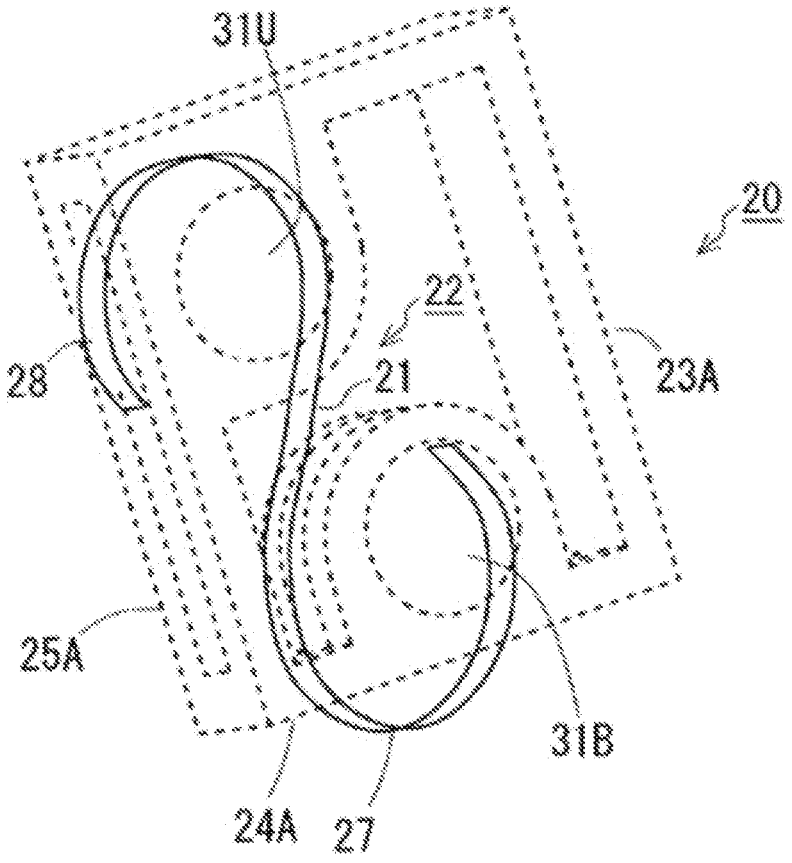
FIG. 14 is a view illustrating an internal structure of the housing according to the modification.

In the above-described embodiment, the housing 23 having a cuboid external appearance has been described as an example. However, the housing accommodating the contact 22 is not limited to the housing having a cuboid external appearance. FIG. 13 is a view illustrating a modification of the housing 23. Further, FIG. 14 is a view illustrating an internal structure of a housing 23A according to the modification. The housing accommodating the contact 22 may be, for example, the housing 23A having a simple rectangular frame shape, as illustrated in FIG. 13.

The housing 23A is opened in the bottom portion 24A thereof which is a portion facing the board 1, and the first contact portion 27 of the contact 22 is raised from the bottom portion 24A. Further, the housing 23A is opened in the lateral portion 25A thereof which is a portion facing another member to be electrically connected to the board 1 via the connector 10, and the second contact portion 28 of the contact 22 is raised from the lateral portion 25A.

Since the bottom portion 24A and the lateral portion 25A of the housing 23A are entirely opened, the housing 23A is provided with displacement suppressing pins 31U and 31B that are configured to suppress displacement of the contact 22. The displacement suppressing pin 31U is inserted through the substantially circular portion formed in the upper portion of the S-shaped spring 21. Further, the displacement suppressing pin 31B is inserted through the substantially circular portion formed in the lower portion of the S-shaped spring 21. Since the displacement suppressing pin 31U is inserted through the substantially circular portion formed in the upper portion of the S-shaped spring 21, and the displacement suppressing pin 31B is inserted through the substantially circular portion formed in the lower portion of the spring 21, the contact 22 is suppressed from being displaced from the inside of the simple frame shaped housing 23A of which the bottom portion 24A and the lateral portion 25A are entirely opened.

Even though the contact 22 is disposed in such a housing 23A, the first contact portion 27 is pressed toward the board 1, and the second contact portion 28 is pressed toward another member.

Figure 15:
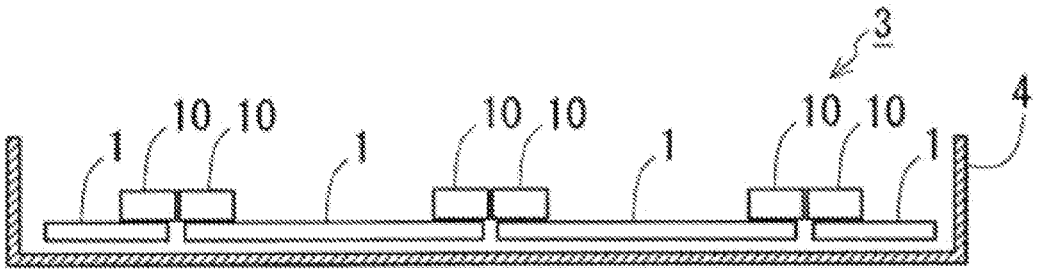
FIG. 15 is a view illustrating an example of an internal structure of an electronic device.

FIG. 15 is a view illustrating an example of an internal structure of an electronic device. For example, a plurality of boards 1 may be fixed in an electronic device 3 in a state of being connected to each other, as illustrated in FIG. 15. When the above-described connectors 10 are used for the electrical connection portions of the respective boards 1, the connectors 10 may be connected to each other by causing the boards 1 to be relatively moved in the direction vertical to the plate surface of each board 1. Therefore, the boards 1 may be fixed one by one in a housing 4 of the electronic device 3.

Figure 16:
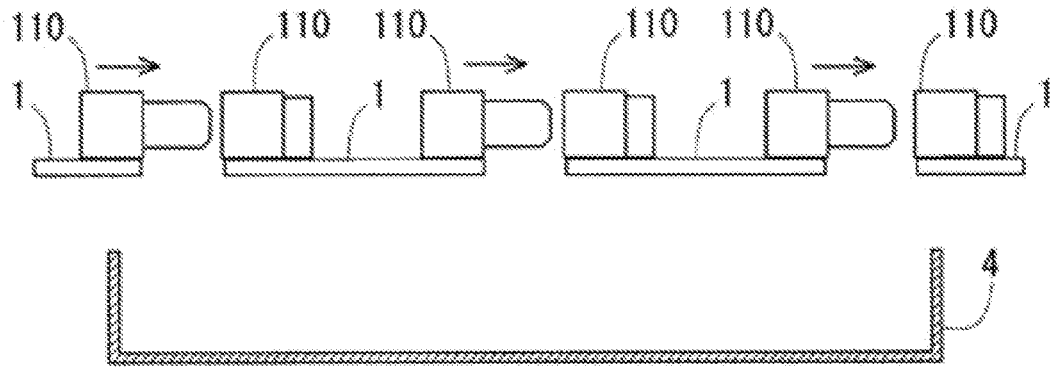
FIG. 16 is a view illustrating an example of a connector according to a comparative example.
Figure 17:
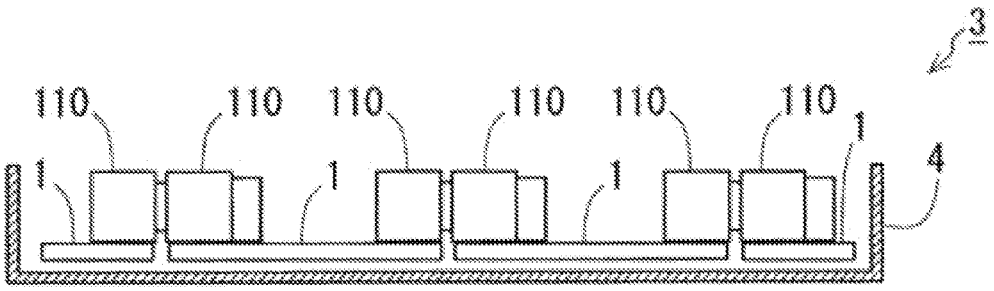
FIG. 17 is a view illustrating a state where boards connected by the connector according to the comparative example are placed in a housing of an electronic device.

FIG. 16 is a view illustrating an example of a connector according to a comparative example. Further, FIG. 17 is a view illustrating an example of a state where boards connected by the connector according to the comparative example are placed in a housing of an electronic device. For example, as illustrated in FIG. 16, when connectors 110 of the comparative example which are fitted with each other in the direction parallel with the plate surface of each board 1 are used, the connectors 110 are connected to each other by causing the boards 1 to be relatively moved in the direction parallel with the plate surface of each board 1, in order to connect the boards 1 to each other. Accordingly, for example, when the inside of the housing 4 is narrow, the boards 1 are connected to each other in advance by the connectors 110 as illustrated in FIG. 16, and then, fixed in the housing 4 as illustrated in FIG. 17. That is, the work of assembling the boards 1 in the housing 4 is difficult. Thus, when the above-described connectors 10 are used, the boards 1 may be fixed one by one in the housing 4 of the electronic device 3 so that the work of assembling the boards 1 in the housing 4 is facilitated.

In the above-described embodiment and modifications, the S, W, and C shapes have been described as an example of the shape of the contact. However, the contact of the present disclosure may have other external appearances. Further, in the above-described embodiment and modifications, the example where the boards 1 are connected to each other has been described. However, the contact and the connector of the present disclosure may be used for connection between a board and other electronic components.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. A contact assembly comprising:

a spring that has a curved portion and conductivity;

a first contact portion that is a part of the curved portion raised from a bottom portion of a housing that holds the spring, the first contact portion comes in contact with a board to which the bottom portion is fixed; and a second contact portion that is a part of the curved portion raised from a first lateral portion of the housing, the second contact portion comes in contact with another member placed next to the board, wherein the housing includes a first support portion that forces a top portion of the spring toward the bottom portion, and a second support portion that forces a second lateral portion opposite to the first lateral portion of the spring toward the lateral portion, and the spring exhibits an elastic force thereof by being supported by the first support portion so as to press the first contact portion toward the board when the first contact portion comes into contact with the board, and exhibits the elastic force by being supported by the second support portion so as to press the second contact portion toward the another member when the second contact portion comes into contact with the another member.

2. The contact assembly according to claim 1, wherein the first contact portion is raised from a window formed in the bottom portion, and the second contact portion is raised from a window formed in the first lateral portion.

3. A connector assembly comprising:

a plurality of contact assemblies each formed by a spring having a curved portion and conductivity; and a housing that holds each of the contact assemblies, wherein each of the contact assemblies includes a first contact portion that is a part of the curved portion raised from a bottom portion of the housing, the first contact portion comes in contact with a board to which the bottom portion is fixed, and a second contact portion that is a part of the curved portion raised from a first lateral portion of the housing, the second contact portion comes in contact with another member placed next to the board, wherein the housing includes a first support portion that forces a top portion of each of the springs toward the bottom portion, and a second support portion that forces a second lateral portion opposite to the first lateral portion of each of the springs toward the lateral portion, and each of the springs exhibits an elastic force thereof by being supported by the first support portion so as to press the first contact portion toward the board when the first contact portion comes into contact with the board, and exhibits the elastic force by being supported by the second support portion so as to press the second contact portion toward the another member when the second contact portion comes into contact with the another member.

4. The connector assembly according to claim 3, wherein the housing has a window in the bottom portion from which the first contact portion is raised, and a window in the first lateral portion from which the second contact portion is raised.

5. The contact assembly according to claim 1, wherein the spring is one of an S-shaped spring, a W-shaped spring, and a C-shaped spring.

6. The contact assembly according to claim 5, further comprising:

first and second displacement suppressing pins configured to suppress displacement of the S-shaped spring, wherein the first displacement suppressing pin is inserted through a substantially circular portion formed in an upper portion of the S-shaped spring, and the second displacement suppressing pin is inserted through a substantially circular portion formed in a lower portion of the S-shaped spring.

* * * * *